US005199385A

United States Patent [19]

Doss

[11] Patent Number: 5,199,385

[45] Date of Patent: Apr. 6, 1993

[54] THROUGH THE WALL VENTED WATER HEATER

[75] Inventor: Garrett L. Doss, Wyoming, Mich.

[73] Assignee: Bradford-White Corp., Ambler, Pa.

[21] Appl. No.: 856,633

[22] Filed: Mar. 24, 1992

[51] Int. Cl.[5] ..... F22B 37/42

[52] U.S. Cl. ..... 122/504; 110/162; 122/13.1; 126/361; 236/14; 431/20

[58] Field of Search ..... 122/504, 448.1, 13.1, 122/17, 18, 14, 446, 447; 126/285.5, 361; 236/14; 110/162; 431/20

[56] References Cited

U.S. PATENT DOCUMENTS

| | | |
|---|---|---|
| Re. 31,256 | 5/1983 | Schmidt . |
| 1,643,859 | 9/1927 | Sauvage . |
| 1,707,281 | 4/1929 | Sauvage . |
| 1,713,442 | 5/1929 | Matcovich . |
| 1,826,748 | 10/1931 | Delamere . |
| 1,859,745 | 5/1932 | Morley . |
| 1,935,919 | 11/1933 | Ronstrom . |
| 2,348,901 | 5/1944 | Handley . |
| 2,348,950 | 5/1944 | Anderson . |
| 2,361,635 | 10/1944 | Koppel . |
| 2,443,359 | 6/1948 | Newhouse . |
| 2,487,689 | 11/1949 | Black . |
| 2,563,817 | 8/1951 | Carson . |
| 2,730,943 | 1/1956 | Klein . |
| 2,847,953 | 8/1958 | Ernst . |
| 2,877,834 | 3/1959 | Campbell . |
| 3,280,774 | 10/1966 | English . |
| 3,490,420 | 1/1970 | Kramer . |
| 3,492,972 | 2/1970 | McLaren . |
| 3,601,099 | 8/1971 | Vaillant et al. . |
| 3,749,032 | 7/1973 | Ehrlichmann et al. . |
| 3,756,202 | 9/1973 | Keith . |
| 3,759,230 | 9/1973 | Cooksley . |
| 3,782,303 | 1/1974 | Pfister et al. . |
| 4,102,632 | 7/1978 | Hastings . |
| 4,185,769 | 1/1980 | Nezworski . |
| 4,191,171 | 3/1980 | Primean . |
| 4,204,832 | 5/1980 | Miller . |
| 4,254,759 | 3/1981 | Schmidt . |
| 4,262,608 | 4/1981 | Jackson . |
| 4,263,890 | 4/1981 | Turko et al. . |
| 4,303,042 | 12/1981 | Sumiyoshi . |
| 4,356,794 | 11/1982 | Bouman et al. . |
| 4,357,909 | 11/1982 | Kogoshima . |
| 4,424,792 | 1/1984 | Shimek et al. . |
| 4,442,798 | 4/1984 | Zanias . |
| 4,485,746 | 12/1984 | Erlandsson . |
| 4,487,137 | 12/1984 | Horvat et al. . |
| 4,531,509 | 7/1985 | Wilhelm, Jr. . |
| 4,672,919 | 6/1987 | Staats . |
| 4,770,160 | 9/1988 | Schimmeyer . |
| 4,803,931 | 2/1989 | Carson . |
| 4,856,982 | 8/1989 | Olson . |
| 4,867,106 | 9/1989 | Staats . |
| 4,981,262 | 1/1991 | Jackson . |

FOREIGN PATENT DOCUMENTS

| | | |
|---|---|---|
| 1036692 | 8/1978 | Canada . |
| 2502063 | 8/1975 | Fed. Rep. of Germany . |
| 3224009 | 2/1983 | Fed. Rep. of Germany . |
| 372147 | 3/1907 | France . |
| 1016381 | 8/1952 | France . |
| 1289923 | 2/1962 | France . |
| 2211110 | 7/1974 | France . |
| 57181703 | 4/1984 | Japan . |
| 7404175 | 3/1974 | Netherlands . |
| 7603212 | 3/1976 | Netherlands . |
| 1224354 | 3/1971 | United Kingdom . |
| 1265957 | 3/1972 | United Kingdom . |
| 2014286A | 8/1979 | United Kingdom . |
| 2026662A | 2/1980 | United Kingdom . |

*Primary Examiner*—Edward G. Favors
*Attorney, Agent, or Firm*—Austin R. Miller

[57] ABSTRACT

The present invention provides a water heater capable of exhausting flue gases from an interior space of a building to an exterior space and is adapted for installation through an upstanding wall. The water heater has an insulated tank with a water inlet and a water outlet together with a flue pipe opening at one end thereof beneath the tank upon a combustion chamber containing a fuel burner. The other end of the flue pipe opens at the top of the tank upon a flue gas collector and has a flue gas restricter for restricting the outward flow of flue gases from the flue pipe. The collector includes a collector box connected to the top of the water heater above and in alignment with the flue pipe, a blower and a low temperature flue gas exhaust line. The collector box has at least one air inlet for mixing air from the interior space of the building with flue gases exiting the flue pipe to inhibit condensation and reduce the temperature of the flue gases flowing through the exhaust line. The water heater has a control for sensing the temperature of water in the tank and regulating the amount of fuel supplied to the burner.

15 Claims, 5 Drawing Sheets

THROUGH THE WALL VENTED WATER HEATER

BACKGROUND OF THE INVENTION

The present invention relates to water heaters, particularly to water heaters capable of venting flue gases at low temperature through the wall of a structure.

FIELD OF THE INVENTION

Over the past several years the need has arisen to provide water heaters in structures or buildings not having traditional chimneys that typically extend upwardly and through the roof thereof. Many new buildings do not have such conventional chimneys extending through the roof because of cost considerations, lack of space and new construction methods and materials. Therefore, it has been desired to provide water heaters capable of venting flue gases outwardly from buildings not having such chimneys.

It has also been desirable to provide water heaters capable of venting flue gases in buildings where venting through traditional chimneys is inconvenient. This can result when it is more convenient to place the water heater at a position remote from the existing chimney. This is especially the case in compact structures not having basements which would otherwise provide for installation of water heaters adjacent an existing chimney.

DESCRIPTION OF PRIOR ART

Applicants are aware of the following U.S. Pat. Nos. relating to water heater apparatus: 1,643,859; 1,707,281; 1,713,442; 1,826,748; 2,348,901; 2,348,950; 2,443,359; 2,487,689; 2,730,943; 3,280,774; 3,490,420; 3,601,099; 3,749,032; 3,756,202; 4,191,171; 4,204,832; 4,262,608; 4,263,890; 4,356,794; 4,424,792; 4,442,798; 4,485,746; 4,487,137; 4,531,509; 4,770,160; 4,803,931; 4,856,982; 4,981,262 and British Patent No. 1,265,957.

Of these, U.S. Pat. Nos. 1,707,281; 4,487,137; 4,803,931; 4,856,982 and 4,981,262 appear to be the most pertinent.

'281 discloses a furnace with a draft system sensing the temperature of flue gases exiting the furnace and controlling a blower in the flue gas exhaust line. The purpose of the blower is to initiate a draft in the blower chamber when the burner is lit. The temperature of flue gases is sensed within this exhaust line to cut off the blower once the blower is established.

'137 discloses an auxiliary exhaust wherein the speed of a blower varies with the sensed temperature of flue gases. The system is intended to introduce room air into the flue gas exhaust line as the temperature of flue gases increases. Increased temperature sensing increases the speed of the blower and therefore the air drawn into the exhaust line.

'931 discloses a flue restricter which controls air flow in flue pipes. The restricter consists of a pair of discs moveable relative to one another to increase or decrease flow of flue gases through the flue gas exhaust line.

'982 discloses a water heater having through the wall features. The water heater includes a time delay switch to purge gases from the flue pipe and the combustion chamber. The time delay is based on sensing the fuel flow through a gas pressure diaphragm switch. A time delay occurs when fuel is cut off from the gas burner. When the main control valve cuts the supply of fuel to the gas burner, the pressure of fuel in the pressure tap leading to the gas pressure diaphragm switch is reduced thereby triggering a microswitch. The microswitch is connected by an electrical wire to the time delay relay timer on the exhaust blower.

'262 discloses a system for supplying combustion air to a furnace which utilizes a blower time delay activated by fuel flow. This system relies on sensing fuel flow for the time delay and is somewhat similar to the '982 patent. Combustion air is brought inwardly from the exterior of the building and a blower motor has a switch responsible for operation of a gas supply valve and a time delay switch to continue operation of the motor and the blower for a period of time after the operation of the heater has completed.

Applicants are also aware of U.S. Pat. Nos. 4,867,106 and 4,672,919 issued to the assignee of the invention herein. The water heaters disclosed in the '106 and '919 patents have proven to be useful for a variety of conditions and uses.

OBJECTS OF THE INVENTION

It is an object of the present invention to provide a water heater capable of use in a structure or building not containing traditional through the roof chimneys.

It is another object of the invention to provide a water heater capable of venting flue gases from an interior space to an exterior space at a comparatively low temperature.

It is a further object of the invention to provide a water heater which may be positioned in a variety of positions within a structure or building either adjacent to or remote from the wall where flue gases exit the structure.

Other objects and advantages of the present invention will become apparent to those skilled in the art from the drawings, the detailed description of preferred embodiments and the appended claims.

SUMMARY OF THE INVENTION

The present invention provides a water heater capable of exhausting flue gases from an interior space of a building to an exterior space and is adapted for installation through an upstanding wall. The water heater has an insulated tank with a water inlet and a water outlet together with a flue pipe opening at one end thereof beneath the tank upon a combustion chamber containing a fuel burner. The other end of the flue pipe opens at the top of the tank upon a flue gas collector and has a flue gas restricter for restricting the outward flow of flue gases from the flue pipe. The collector includes a collector box connected to the top of the water heater above and in alignment with the flue pipe, a blower and a low temperature flue gas exhaust line. The collector box has at least one air inlet for mixing air from the interior space of the building with flue gases exiting the flue pipe to inhibit condensation and reduce the temperature of the flue gases flowing through the exhaust line.

The water heater has a control for sensing the temperature of water in the tank and regulating the amount of fuel supplied to the burner. The water heater also includes a device for activating and deactivating the blower in response to controlling the fuel. The water heater further includes a sensor for sensing the temperature of the mixture of flue gases and air from the interior space and for interrupting the fuel supply to the burner in response thereto. A further sensor senses the temperature of the mixture of flue gases and air from the interior space to continue blower operation for a desired period of time after the fuel burner stops operating. There is further provided a valve for preventing flow of fuel to the fuel burner when the power supply to the water heater has been interrupted.

DETAILED DESCRIPTION OF THE INVENTION

Figure 1:
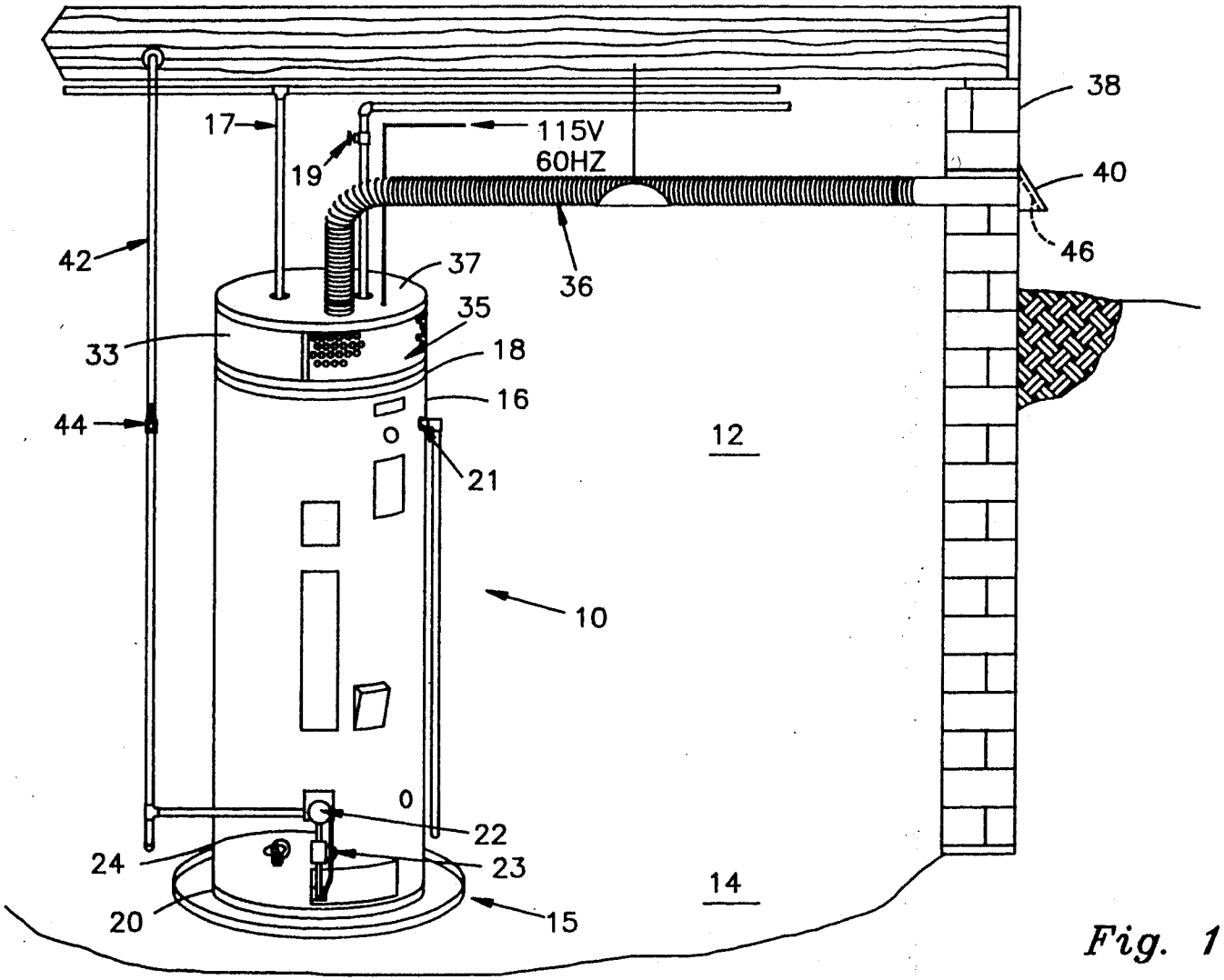
FIG. 1 shows a schematic perspective view of a water heater of the invention having a flue gas line extending through the wall of a structure.

It will be appreciated that the following description is intended to refer to the specific embodiment of the invention selected for illustration in the drawings and is not intended to define or limit the invention other than in the appended claims.

Figure 2:
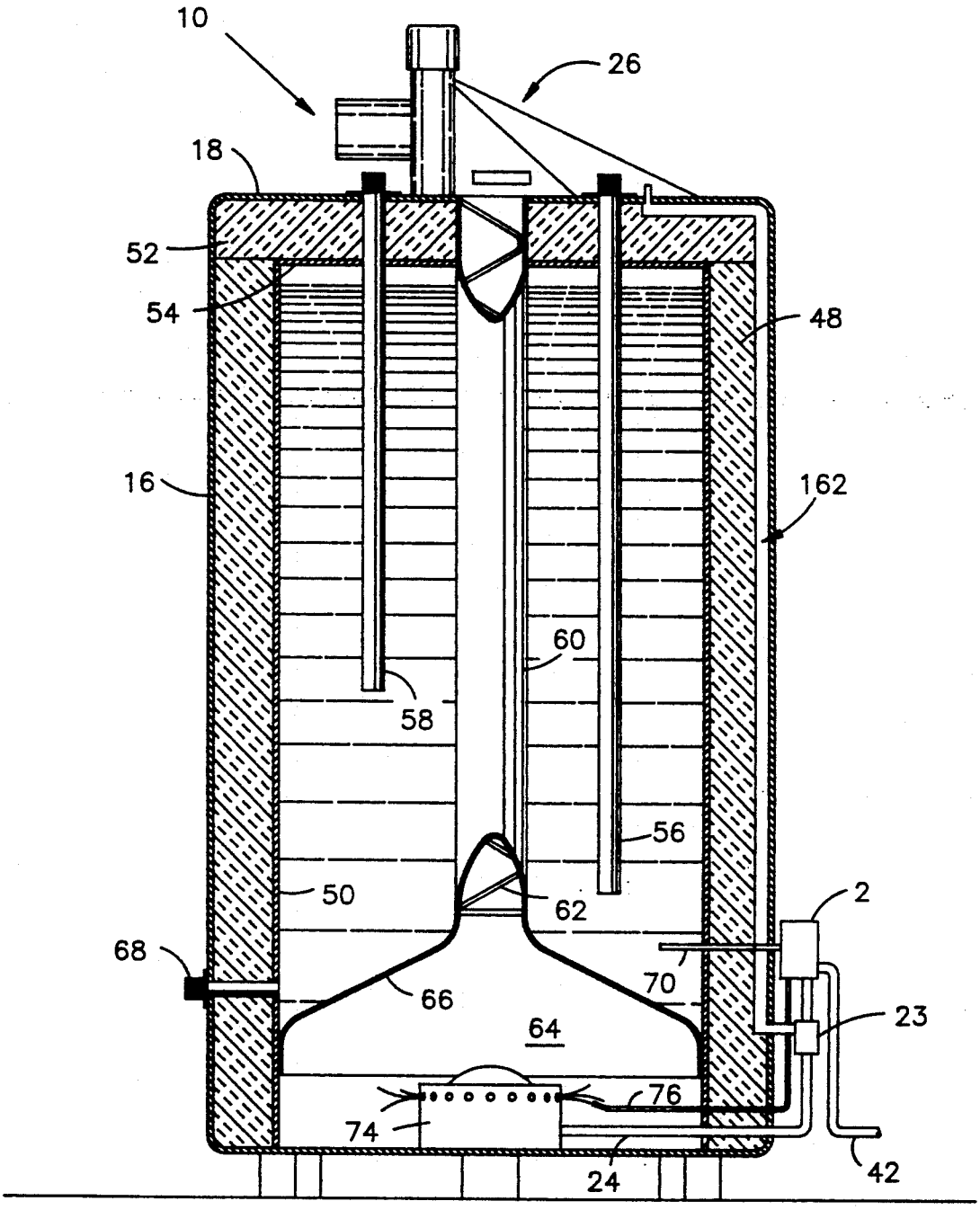
FIG. 2 is a schematic side view, taken partially in section, of a water heater of the invention.

Turning now to the specific form of the invention illustrated in the drawings and referring particularly to FIGS. 1 and 2, the number 10 designates a water heater in accordance with aspects of the invention. Water heater 10 is positioned within a room 12 and stands on floor 14 and in drain pan 15. Water heater 10 includes a jacket 16, top cover 18, bottom pan 20, hot water line 17, cold water line 19 and pressure release line 21. Controller 22 is positioned on the side of jacket 16 and connects to gas supply line 24 and connects to gas inlet line 42 having gas valve 44. Solenoid valve 23 is positioned on gas supply line 24 between controller 22 and burner 74. Solenoid valve 23 also connects to pressure supply line 162. Flue gas collector 26 is positioned on top of top cover 18 and includes a blower motor 28, blower motor housing 30 and a collector box 32. Flue gas collector 26 is surrounded by enclosure 33 which has a top pan 37 and a perforated screen access panel 35.

Exhaust line 36 connects to blower motor housing 30 and extends through wall 38 exteriorly of room 12. Vent cover 40 is positioned on the exterior end of exhaust line 36. Vent cover 40 also includes a hinged flap 46 (shown by dashed lines) connected to the end of exhaust line 36.

FIG. 2 shows water heater 10 taken in section to show the interior thereof. Jacket 16 surrounds a foam insulation 48 which in turn surrounds water tank 50. Top insulation 52 lies between top cover 18 and the head 54 of water tank 50. Cold water inlet line 56 extends downwardly through top pan 37, top cover 18, through top insulation 52 and into water tank 50. Similarly, hot water outlet 58 extends downwardly through top pan 37, top cover 18 and through top insulation 52 into water tank 50. Flue pipe 60 extends upwardly through water tank 50 and includes baffles 62. Flue pipe 60 opens at the bottom of water tank 50 into a combustion chamber 64 which has a roof 66. Water tank 50 also has a drain pipe 68 and a temperature sensor 70. Sensor 70 connects to controller 22 which is mounted onto the side of jacket 16. Controller 22 connects to gas supply line 24 to supply fuel to burner 74. Controller 22 further connects to pilot line 76 and gas inlet line 42. Flue gas collector 26 is connected to top cover 18 and connects to pressure supply line 162.

Figure 5:
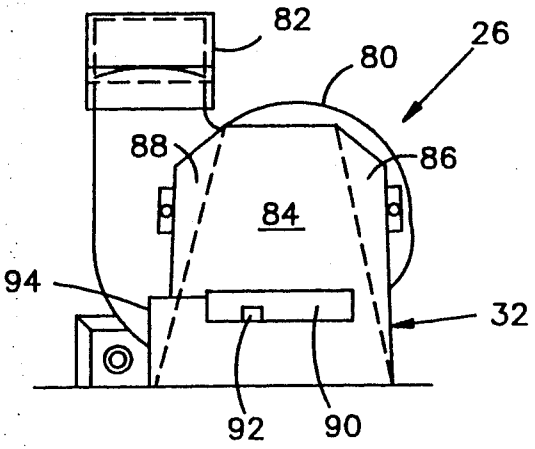
FIG. 5 shows an end elevational view of the collector of FIG. 3.
Figure 3:
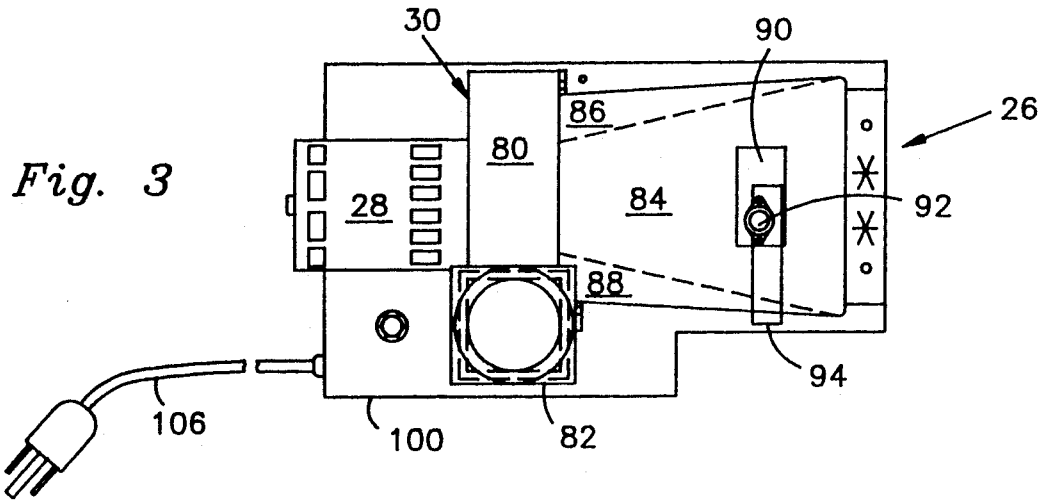
FIG. 3 shows a top plan view of a flue gas collector and blower portion of the water heater of the invention.
Figure 4:
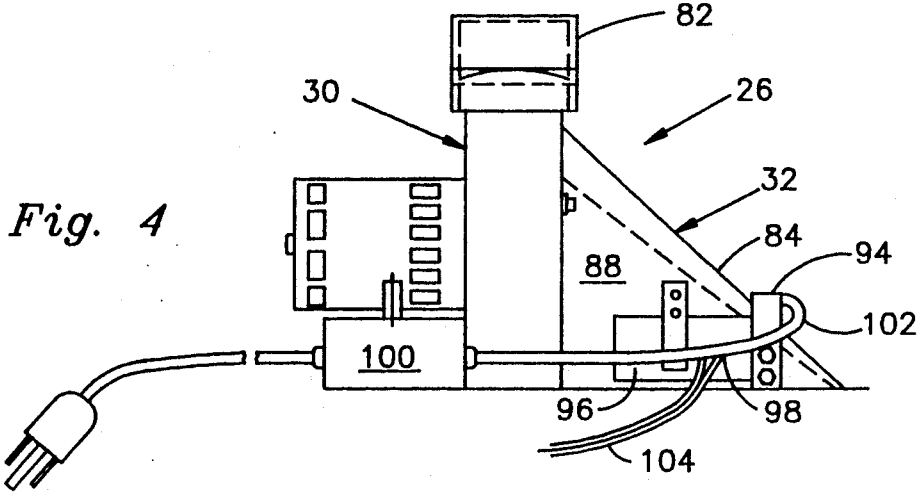
FIG. 4 shows a side elevational view of the collector shown in FIG. 3.

FIGS. 3, 4 and 5 show top, side and end views, respectively, of flue gas collector 26. Flue gas collector 26 includes blower motor 28, which connects to blower motor housing 30. Blower motor housing 30 includes mixing chamber 80 and outlet 82. Flue gas collector 26 also includes collector box 32. Collector box 32 includes an inclined top 84 and inclined sides 86 and 88. Inclined top 84 has an air inlet 90 and a temperature sensor 92 mounted on a bracket 94 and positioned in air inlet 90. Inclined side 88 also has an air inlet 96 and a temperature sensor 98. Sensor 92 connects to junction box 100 by wire 102 and sensor 98 connects to controller 22 by wire 104. Power supply cord 106 connects to junction box 100, which also connects to blower motor 28.

Figure 6:
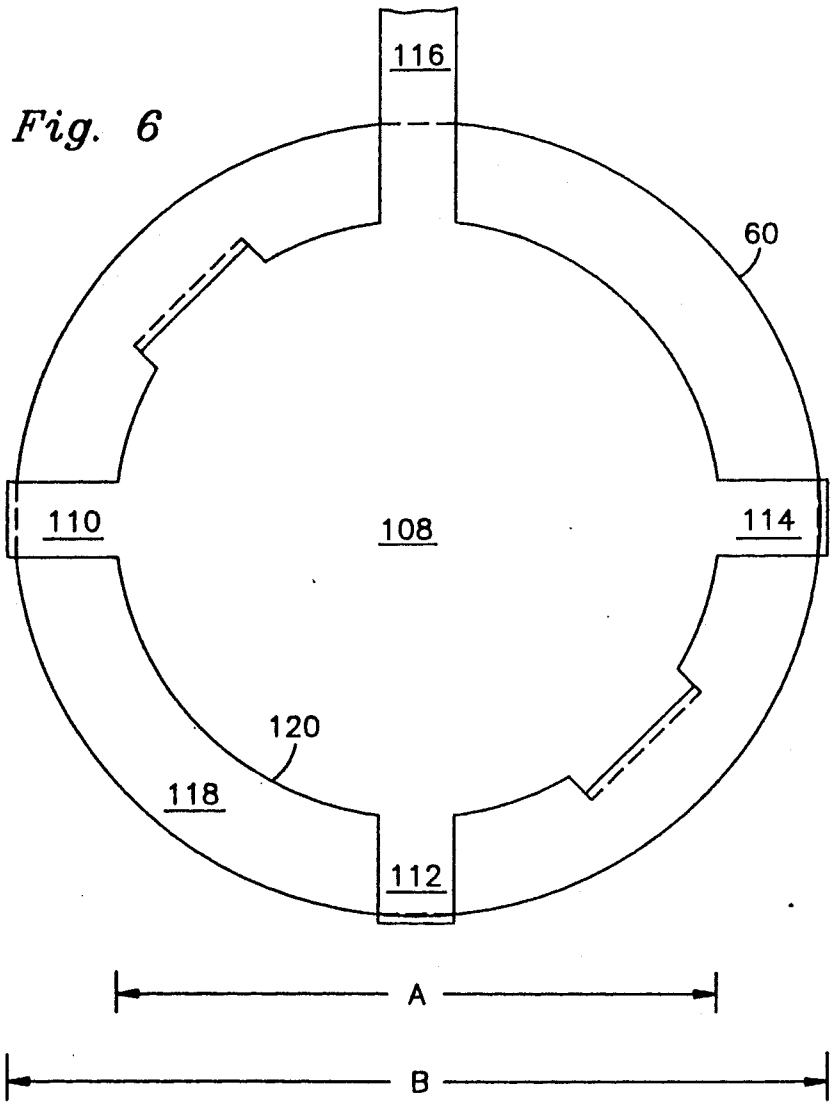
FIG. 6 shows a top plan view of a restricter resting on a flue pipe of a water heater of the invention.

FIG. 6 shows restricter plate 108 suspended over the opening of flue pipe 60. Arms 110, 112 and 114 extend radially outwardly from the center of restricter plate 108 and engage the uppermost end of flue pipe 60. The diameter of plate 108, as represented by the arrows A in FIG. 6, is less than the diameter of flue pipe 60 as represented by the arrows B also shown in FIG. 6. This creates an intervening space 118 between the edge 120 of restricter plate 108 and flue pipe 60 for passage of flue gases outwardly from water heater 10.

Figure 7:
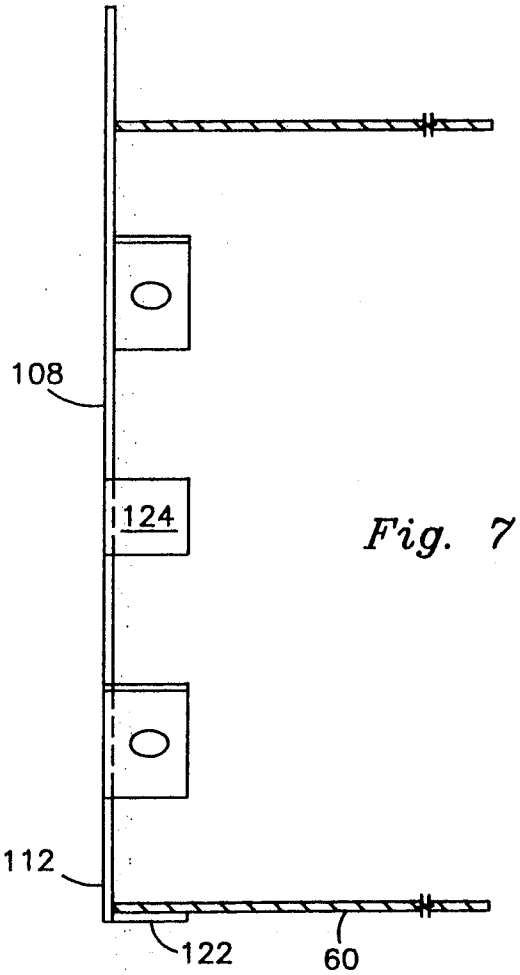
FIG. 7 shows a side elevational view, partly taken in section, of the restricter of FIG. 6 resting on a flue pipe.

FIG. 7 shows restricter plate 108 of FIG. 6 suspended on flue pipe 60. Arm 112 has an angled retainer portion 122 to maintain restricter plate 108 in a relative desired position. Retainer portion 124 connects to arm 114 and serves the same purpose.

Figure 8:
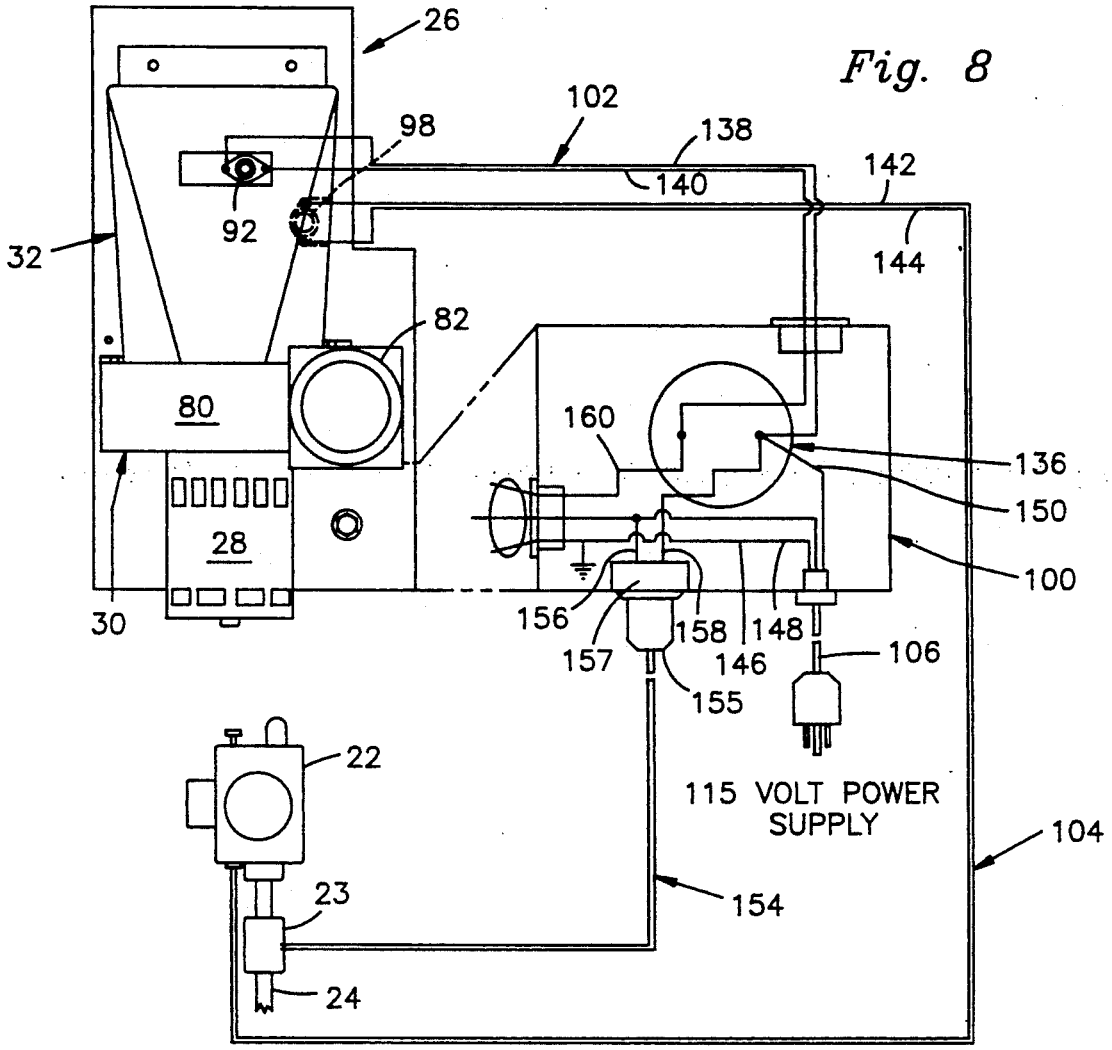
FIG. 8 shows schematic wiring diagram of one embodiment of the burner and blower control apparatus utilized in the invention.
Figure 9:
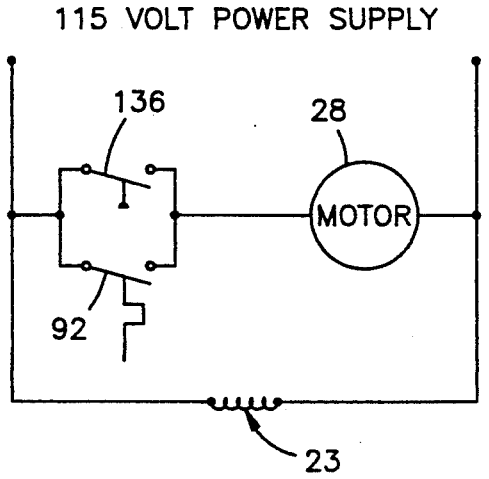
FIG. 9 shows a ladder diagram of a portion of the blower control circuit from FIG. 8.

FIGS. 8 and 9 show electrical connections between flue gas collector 26 and controller 22. FIG. 8 is similar to FIG. 3 except that junction box 100 is shown in an exploded form and includes details of numerous wire connections. For example, temperature sensor 92 connects to pressure switch 136 by wires 138 and 140, which are integrally shown as wire 102 in FIG. 4. Temperature sensor 98 connects to controller 22 by wires 142 and 144, which are integrally shown as wire 104 in FIG. 4. Power supply cord 106 breaks into three wires 146, 148 and 150. Wires 146 and 148 connect to motor 28 and wire 150 connects to pressure switch 136. Solenoid 23 connects to junction box 100 through connector wire 154. Connector wire 154 terminates at plug 155. Plug 155 engages receptacle 157 which connects to wires 156 and 158. Wire 156 connects to wire 148 and wire 158 connects to wires 150 and 138 at their terminal ends. Wire 160 connects between motor 28 and pressure switch 136.

FIG. 9 shows a ladder diagram of pressure switch 136 and temperature sensor 92 in parallel with one another and in series with blower motor 28. All components are connected to a power supply. Solenoid 23 is also connected to the power supply.

Referring now to the drawings generally, the operation of water heater 10 will now be described.

Temperature sensor 70 detects the temperature of water within water tank 50 and causes controller 22 to supply fuel to burner 74 from gas supply line 24 in a manner well known in the art. Burner 74 ignites the fuel and produces flames, heat and combustion gases which enter combustion chamber 64. Combustion gases rise upwardly through flue pipe 60 and into flue gas collector 26. Heat is transferred to water in water tank 60 through roof 66 and flue pipe 60.

At the time controller 22 causes fuel to be supplied to burner 74, it also supplies gas pressure through solenoid valve 23 and pressure supply line 162 to pressure switch 136. Pressure switch 136 is normally in an "open" condition when burner 74 is off and "closes" upon receipt of gas pressure through pressure supply line 162 when the burner switches on. "Closing" of pressure switch 136 "closes" the circuit between blower motor 28 and the power supply, thereby causing blower motor 28 to activate.

Activation of blower motor 28 causes air from the interior space of the room in which water heater 10 is located to move inwardly through air inlets 90 and 96, for example, and mixes with flue gases exiting upwardly through flue pipe 60 and into a collector box 32. Combustion gases and interior room air mix in a predetermined ratio and enter mixing chamber 80 and exit through outlet 82 into exhaust line 36, through wall 38 and outwardly by way of vent cover 40 into the exterior atmosphere.

Temperature sensor 70 continues to monitor the temperature of water contained within water tank 50 and causes controller 22 to shut off the supply of fuel to burner 74 when the water reaches a predetermined temperature in a well known manner. When controller 22 shuts off the supply of fuel to burner 74, it also shuts off the supply of fuel to pressure supply line 162. This causes a reduction in the fuel pressure applied against pressure switch 136, thereby permitting pressure switch 136 to move from a "closed" condition to an "open" condition.

"Opening" of pressure switch 136 does not immediately result in deactivation of blower motor 28. This is caused by the "closed" condition of temperature sensor 92 during water heater operation. Temperature sensor 92 "closes" at a predetermined temperature during burner operation, such as 170° F., for example, when hot flue gases enter collector box 32, and remains in a "closed" condition until the temperature of air and flue gases in collector box 32 is reduced to a second predetermined temperature, such as 135° F., for example, at which time sensor 92 "opens". Thus, during water heater operation, mixed flue gases and interior room air in collector box 32 cause temperature sensor 92 to revert to a "closed" condition. This "closed" condition completes an electrical circuit between the power supply and blower motor 28. Temperature sensor 92 and pressure switch 136 are connected in parallel, as illustrated in FIG. 9 of the drawings, and motor 28 continues to run until the temperature of interior room air and flue gases sensed by temperature sensor 92 decreases to a predetermined temperature, such as 135° F., at which time temperature sensor 92 reverts to an "open" condition, thereby cutting off blower motor 28.

This is an important and advantageous feature of the present invention. It is highly desirable to insure that substantially all of the combustion gases produced by burner 74 are efficiently and completely caused to exit the structure or building through exhaust line 36. Combustion gases continue to flow upwardly through flue pipe 60 for some time after burner 74 cuts off. Therefore, it is highly desirable to have a reliable and efficient means for insuring that remaining combustion gases residing in combustion chamber 64 and flue pipe 60 after burner cut off are removed from the interior space.

Temperature sensor 98 provides a further important and advantageous feature of the invention. In the unlikely event water heater 10 has some malfunction, such as failure of motor 28 to operate correctly, temperature sensor 98 senses the temperature of interior space air and flue gases inside collector box 32 and is capable of completely shutting down all operations of water heater 10 if the temperature of the air and flue gases within collector box 32 exceeds a predetermined maximum. Temperature sensor 98 connects to controller 22 and causes an electromagnetic valve within controller 22 to shut off the supply of fuel to burner 74 and pilot line 76. The predetermined temperature can be any desired temperature, such as 210° F. for 75 and 38 gallon water heaters or 200° F., for example, for 48 gallon water heaters. Solenoid 23 is also capable of interrupting the supply of fuel to burner 74 when the power supply is interrupted for any reason.

It is important in the invention that the temperature of the flue gases travelling outwardly from flue pipe 60 are maintained at or below a predetermined temperature to prevent formation of condensation--which tends to severely reduce water heater efficiency and decreases water heater life span due to corrosion. This predetermined temperature is sufficiently low so that exhaust line 36 can be manufactured from low temperature materials such as CPVC, PVC, EPDM or ABS pipe or polymeric pleated and wire reinforced vent pipe typically used with residential clothes dryers, for example. Maintaining the temperature at or below a certain temperature prevents troublesome or harmful condensation from forming in the exhaust line 36 by careful metering of interior space air into collector box 32. This metering is achieved with a restricter plate 108 positioned at the top of flue pipe 60. Restricter plate 108 is suspended substantially concentrically on top of flue pipe 60. Its diameter "A" as shown in FIG. 6 is sized in a manner to be less than the diameter of flue pipe 60 as shown by the arrow "B" also shown in FIG. 6. The difference in the diameters "A" and "B" provides a space 118 through which flue gases are free to move upwardly into collector box 32 from flue pipe 60.

It has been found that the ratio of the diameter of restricter plate 108 to the diameter of flue pipe 60 should be about 0.8. This permits the ratio of mixture of interior space air with flue gases to mix at about 4 to 1 at the blower inlet. This insures that the mixture of air and flue gases traveling through exhaust line 36 will be sufficiently low and that exhaust line 36 will remain free of undesirable and potentially harmful condensation. The mixture of interior space air and flue gases exit through vent cover 40 and hinge plate 46 in a conventional manner.

Although this invention has been described in connection with specific forms thereof, it will be appreciated that a wide array of equivalents may be substituted for the specific elements shown and described herein without departing from the spirit and scope of this invention as described in the appended claims. For example, many types of insulation may be used between the jacket 16 and water tank 50. Various materials such as plastics or metal may be employed for jacket 16. Also, numerous types of burners 74, controllers 22, water inlets and outlets 56 and 58 can be substituted for those illustrated herein

I claim:

1. A water heater capable of exhausting flue gases from an interior space of a building to an exterior space, said water heater having a tank with a water inlet and a water outlet, a flue pipe opening and a combustion chamber containing a fuel burner, said flue pipe opening at the top of the tank upon flue gas collection and exhaust means, said collection and exhaust means including a collector connected to the top of the water heater above and in alignment with the flue pipe, a blower and a low temperature flue gas exhaust line, said collector having at least one air inlet for mixing air from the interior space with flue gases exiting said flue pipe to inhibit condensation and reduce the temperature of flue gases flowing through the exhaust line, said water heater having control means for sensing the temperature of water in the tank and regulating the amount of fuel supplied to the burner, means for activating and deactivating the blower in response to controlling said fuel and including first means for sensing the temperature of a mixture of flue gases and air from the interior space and interrupting the fuel supplied to the burner in response thereto and second means for sensing the temperature of the mixture of flue gases and air from the interior space to continue blower operation until the mixture of flue gases and air reach a desired temperature after said fuel burner stops operating, and means for preventing flow of fuel to the fuel burner when the power supplied to said water heater has been interrupted.

2. The water heater defined in claim 1 further comprising means for restricting flue gas flow including a substantially round plate positioned substantially concentrically with respect to said flue pipe at said other end.

3. The water heater defined in claim 2 wherein the ratio of the diameter of the plate to the diameter of the flue pipe is about 0.8.

4. The water heater defined in claim 1 wherein the means for restricting flow is sized to cause air from the interior space to mix with flue gases in a ratio of about 4 to 1.

5. The water heater defined in claim 2 further including at least two suspension arms extending outwardly from the plate and connected to the flue pipe at said other end.

6. The water heater defined in claim 1 wherein said collector has two inclined sides and an inclined top member.

7. The water heater defined in claim 6 wherein each side and the top member have at least one air inlet.

8. The water heater defined in claim 6 wherein said collector is substantially sealed to the top of the water heater.

9. The water heater defined in claim 6 wherein said collector connects to a blower housing at an opening in said collector formed by the sides and top member.

10. The water heater defined in claim 1 wherein the second means includes a temperature sensitive switch connected in parallel with the means for activating and deactivating the blower, said temperature sensitive switch maintaining said blower in operation after the flow of fuel has been interrupted and until the temperature of flue gases and interior space air sensed in the collector is below a predetermined temperature, said temperature sensitive switch interrupting power supplied to the blower when the temperature sensed in the collector is below the predetermined temperature.

11. The water heater defined in claim 1 wherein the first means includes a first temperature sensitive switch connected to said means for regulating the amount of fuel supplied to the burner, said first temperature sensitive switch causing said means for regulating the amount of fuel to reduce the flow of fuel to the burner when the temperature of the mixture of flue gases and interior space air exceeds a predetermined temperature.

12. The water heater defined in claim 1 wherein the means for activating and deactivating the burner includes a temperature sensitive controller.

13. The water heater defined in claim 1 wherein the means for preventing flow of fuel to the fuel burner includes a solenoid.

14. A water heater capable of exhausting flue gases from an interior space of a building to an exterior space, said water heater having a tank with a water inlet and a water outlet, a flue pipe and a combustion chamber containing a fuel burner, said flue pipe opening at one end at the top of the tank upon flue gas collection and exhaust means and having a plate positioned at said end of said flue pipe for restricting the outward flow of the flue gases from said flue pipe, said collection and exhaust means including a collector connected to the top of the water heater above and in alignment with the flue pipe, a blower and a low temperature flue gas exhaust line, said collector having at least one air inlet for mixing air from the interior space with flue gases exiting said flue pipe to inhibit condensation and reduce the temperature of flue gases flowing through the exhaust line, said water heater having a water temperature sensor extending into said water tank and a control valve connected to regulate the amount of fuel supplied to the burner, a fuel pressure sensitive switch connected to the blower to activate and deactivate the blower in response to controlling said fuel and including a first temperature sensor switch positioned in the collector to sense the temperature of a mixture of flue gases and air from the interior space and interrupting the fuel supplied to the burner in response thereto and a second temperature sensor switch positioned in the collector to sense the temperature of the mixture of flue gases and air from the interior space to continue blower operation until the mixture of flue gases and air reach a desired temperature after said fuel burner stops operating, and a power sensitive switch connected between said burner and said control valve for preventing flow of fuel to the fuel burner when the power supplied to said water heater has been interrupted.

15. A water heater capable of exhausting flue gases from an interior space of a building to an exterior space and adapted for installation through an upstanding wall comprising:

a water tank with a water inlet and a water outlet;

a combustion chamber positioned under said water tank and having a fuel burner;

a flue pipe positioned between the top of the water tank and the combustion chamber, the flue pipe having a baffle to restrict the flow of flue gases;

a water temperature sensor extending into said water tank and a valve responsive to the sensed temperature to control the flow of fuel to the burner;

a collector connected to the top of the water heater and located to receive flue gases from the flue pipe, said collector having a blower for drawing air from said interior space into said collector for mixture with the flue gases exiting said flue pipe in a ratio of at least about 4 parts air to 1 part flue gas and pushing the mixture of flue gases and air through an exhaust line connected between the blower and the exterior space;

a fuel pressure sensitive switch to activate and deactivate the blower in response to controlling said fuel;

a first temperature sensitive switch to sense the temperature of said mixture of flue gases and air from the interior space and interrupting the fuel supplied to the burner in response thereto;

a second temperature sensitive switch to sense the temperature of said mixture of flue gases and air from the interior space to continue blower operation until the sensed temperature falls below a predetermined temperature; and a power sensitive switch connected between the control valve and the burner for interrupting the flow of fuel to the burner when the power supplied to the water heater has been interrupted.

* * * * *